US006401715B1

(12) United States Patent
Lüthe

(10) Patent No.: US 6,401,715 B1
(45) Date of Patent: Jun. 11, 2002

(54) CARRYING DEVICE FOR A RESPIRATOR

(75) Inventor: Jörn Lüthe, Kiel (DE)

(73) Assignee: Dräger Sicherheitstechnik GmbH (DE)

( * ) Notice: Subject to any disclaimer, the term of this patent is extended or adjusted under 35 U.S.C. 154(b) by 0 days.

(21) Appl. No.: 09/441,417

(22) Filed: Nov. 16, 1999

(30) Foreign Application Priority Data

Jun. 4, 1999 (DE) ..... 299 09 732

(51) Int. Cl.[7] ..... A62B 17/00

(52) U.S. Cl. ..... 128/205.28; 128/202.19; 128/201.22; 128/201.29; 2/94

(58) Field of Search ..... 128/205.22, 201.22, 128/201.29, 202.19; 405/186, 187, 455, 456, 92, 102, 915; 24/3.1; 224/158, 905, 907, 934, 101, 148.1, 148.7; 2/94; 182/3

(56) References Cited

U.S. PATENT DOCUMENTS 2,970,316 A * 2/1961 Silin ..... 2/94
3,973,643 A * 8/1976 Hutchinson ..... 182/3
4,272,852 A * 6/1981 Bell ..... 2/94
4,273,216 A * 6/1981 Weissmann ..... 182/3
4,377,163 A * 3/1983 Feathers ..... 128/205.22
5,188,267 A * 2/1993 Sargent et al. ..... 224/215
5,249,890 A * 10/1993 Bergstrom ..... 405/186
5,309,571 A * 5/1994 Huang ..... 2/458
5,363,790 A * 11/1994 Matsuoka ..... 114/315
5,370,113 A * 12/1994 Parsons ..... 128/205.22
5,492,110 A * 2/1996 Lenz et al. ..... 128/202.22
5,562,513 A * 10/1996 Kaiser ..... 441/111
5,584,287 A * 12/1996 Smith et al. ..... 128/202.22
5,607,258 A * 3/1997 Eungard ..... 405/186
5,620,282 A * 4/1997 Stinton ..... 405/186
5,641,247 A * 6/1997 Seligman ..... 405/186
5,887,585 A * 3/1999 Dusenbery ..... 128/202.14
5,893,370 A * 4/1999 Perez et al. ..... 2/94
5,902,073 A * 5/1999 Eungard et al. ..... 405/187
5,909,802 A * 6/1999 Puco et al. ..... 2/102
6,030,147 A * 2/2000 Bowden ..... 405/186
6,050,261 A * 4/2000 Lewis et al. ..... 128/205.22
6,120,213 A * 9/2000 Stinton ..... 405/186
6,227,198 B1 * 5/2001 Wiegand et al. ..... 128/201.27
6,295,650 B1 * 10/2001 Baacke ..... 2/462

FOREIGN PATENT DOCUMENTS

CH 591 256 9/1977

* cited by examiner

*Primary Examiner*—John G. Weiss
*Assistant Examiner*—Mital Patel
(74) *Attorney, Agent, or Firm*—McGlew and Tutle, P.C.

(57) ABSTRACT

A carrying device for a respirator is combined with protective clothing. The combination includes shoulder belts and waist belts on the carrying device. Quick-connection elements are provided at the ends of the shoulder belts and of the waist belts. Coupling elements are provided on the protective clothing for the quick-connection elements.

20 Claims, 4 Drawing Sheets

CARRYING DEVICE FOR A RESPIRATOR

FIELD OF THE INVENTION

The present invention pertains to a carrying device for a respirator in combination with protective clothing.

BACKGROUND OF THE INVENTION

Prior-art respirators are usually fastened to the back of a user of the device by means of a carrying frame. Essentially individual compressed gas tanks, in which the breathing gas needed for use is carried along, are arranged on the carrying frame. The carrying frame is provided with belts, which are first placed over protective clothing and are then connected to one another. A so-called shoulder belt and a waist belt are needed to fasten the carrying frame. A respirator of this type is described in CH-PS 591 256.

The drawback of the prior-art respirator is that relatively much time is needed for attaching the carrying frame, because the belts must first be placed loosely over the protective clothing in order to then be able to be connected to the corresponding opposite pieces: However, extremely short times are obligatory for putting on the personal protective clothing in many use situations, e.g., firefighting or rescue missions.

SUMMARY AND OBJECTS OF THE INVENTION

The primary object of the present invention is to improve a carrying device of the above-described type such that it can be arranged on the protective clothing of the user of the device in a simple manner.

According to the invention, a carrying device for a respirator is combined with protective clothing. The combination includes shoulder belts and waist belts on the carrying device. Quick-connection elements are provided at the ends of the shoulder belts and of the waist belts. Coupling elements are provided on the said protective clothing for the quick-connection elements.

The advantage of the present invention is essentially that the interfaces for fastening the carrying device are arranged directly on the protective clothing. The belts of the carrying device are provided for this purpose with quick-connection elements, which can be connected to corresponding coupling elements on the protective clothing. The quick-connection elements are designed such that they can be separated from the coupling elements by pressing a button, so that a rapid removal of the carrying device is thus also possible. The carrying device is comparable to an exoskeleton, to which both the compressed gas supply unit needed for use and implements can be fastened.

It is especially advantageous for the coupling elements to be arranged on the protective clothing such that they are connected to one another via belts led within the protective clothing. As a result, a uniform flow of force is achieved from the carrying belt to the upper body of the user of the device, without the material of the protective clothing being appreciably subjected to tensile or compressive stresses.

It is particularly advantageous for the waist belt to be designed as a one-piece, U-shaped hard shell part. As well it may consist of a flexible non-flamable U-shaped material covered by hard shell parts only at its both ends. Such a waist belt protects the user of the device from possible injury in the region of the hip.

A modular design of the respirator can be achieved by means of a carrying device that is provided with a middle part connecting the shoulder belt and the waist belt, wherein a gas supply line and plug type connections for a compressed gas reservoir are arranged on the middle part. One of these plug type connections is used to mechanically connect the compressed gas reservoir to the carrying device, while the other is designed as a plug type gas connection, with which the gas connection to the gas supply line is established. Due to the plug type connections between the carrying device and the compressed gas reservoir, an emptied compressed gas reservoir can be replaced with a filled one in a simple manner, without any screw connections having to be separated.

The middle part is designed as a longitudinally adjustable part for adjustment to different body heights.

It is particularly advantageous for the waist belt to be connected to the middle part by means of a hinge. The rotatable mounting makes it possible for the user of the device to move largely unhindered with his gear.

It is advantageous for the plug type gas connection for the compressed gas reservoir to be fastened in the area of the hinge and at the same time to combine the plug type gas connection with a pressure reducing valve. A knurled wheel used to set the pressure reducing valve can now be mounted such that it points downward and can be actuated by the user of the device with one hand.

The knurled wheel is preferably arranged on a surface sloping toward the body, so that even though it can be operated by the user of the device, an accidental change in its setting from the outside is avoided. A nose arranged on the knurled wheel provides information on the degree of opening of the pressure reducing valve.

On the discharge side of the pressure reducing valve, the gas supply line extends over the middle part and up to one of the shoulder belts. The gas supply line is led in a protective tube within the middle part in order to reduce the risk of severing the gas supply line by falling sharp-edged objects. In the area of the shoulder belts, the gas supply line is provided with a quick disconnect in order to have a possibility of connection there for a demand oxygen system located on a breathing mask.

It is particularly advantageous to provide plug type connection elements for a shoulder protection shield on the shoulder belts. Such shoulder protection shields cover the shoulder region of the user of the device and also the gas supply line extending in the area of the shoulder belt and offer protection against extreme heat and impacts by falling objects. It is advantageous for the shoulder protection shield to be designed as a double shell made of a plastic molding. The suitable materials are heat-resistant plastics, e.g., PA 6 CF with carbon fibers added. Additionally the shoulder protection shields provide space for electronic retrofit components.

A modular design of a safety equipment, which can be rapidly adapted to different requirements, can be achieved with the carrying device described in the present invention. For example, only one compressed gas reservoir is fastened to the carrying device in the standard equipment. If heat protection is needed for special uses, the shoulder protection shield may be additionally attached to the shoulder belts.

The carrying device according to the present invention is also suitable for circulatory respirators and for diving equipment.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
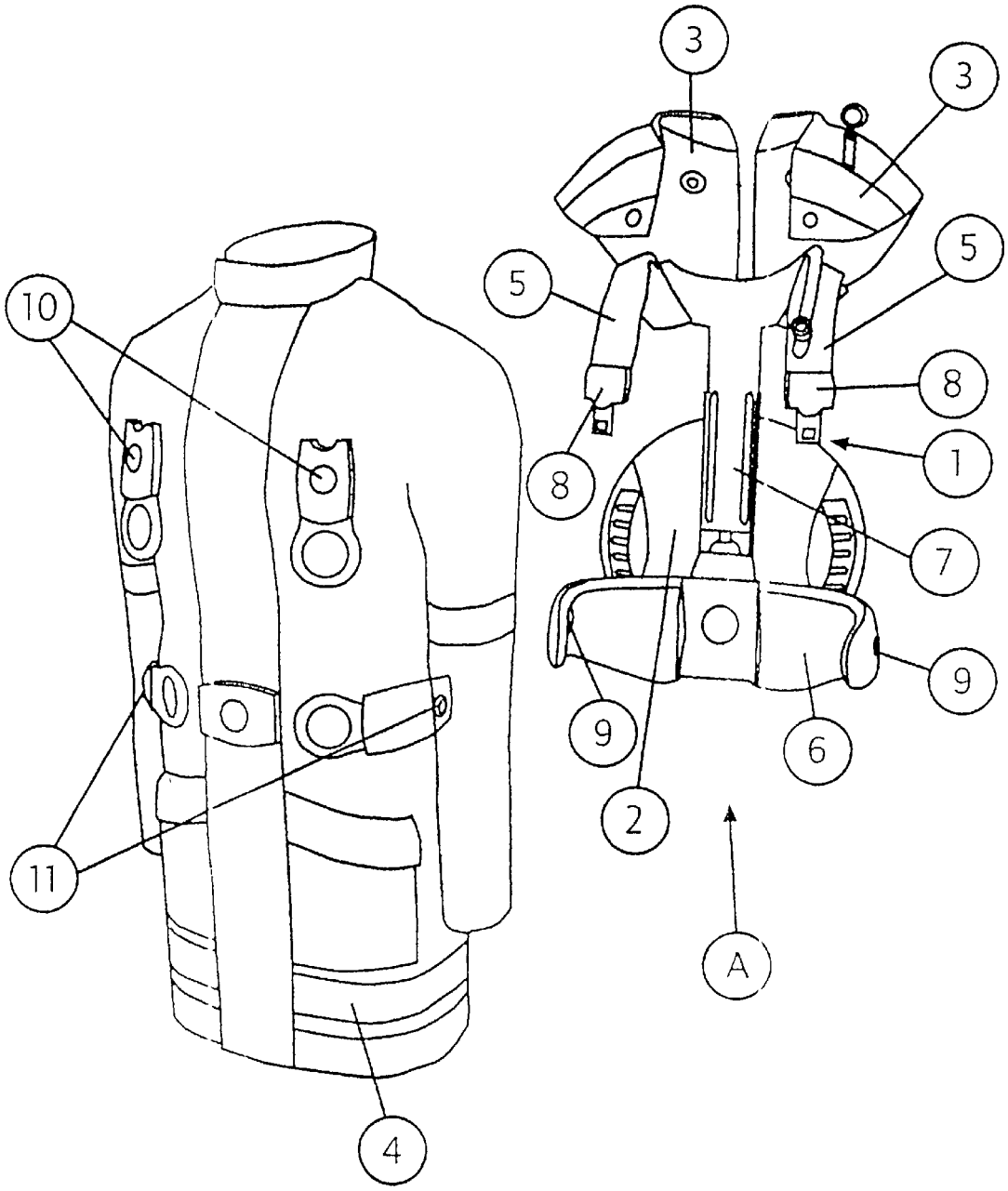
FIG. 1 is an perspective view of a carrying device combined with protective clothing shown separated from each other.

FIG. 1 schematically shows a perspective view of a carrying device 1 for a compressed gas reservoir 2 and a shoulder protection shield 3 for being placed on protective clothing 4. The carrying device 1 comprises two shoulder belts 5, two waist belts 6 and a middle part 7 connecting the shoulder belts 5 to the waist belts 6. Quick-connection elements, such as shoulder connectors 8, and waist connectors 9, which can be locked in corresponding coupling elements such as shoulder couplings 10 and waist coupling 11 located on the protective clothing 4 and can be separated by pressing a button, are located at the ends of the shoulder belts 5 and of the waist belts 6. The coupling elements 10, 11 are connected to one another via belts extending within the protective clothing and not shown in FIG. 1 such that the force flows from the carrying device 1 via the belts directly to the upper body of a user of the device, who is likewise not shown in FIG. 1. As a result, the material of the protective clothing 4 is not subject to any appreciable tensile or compressive stress.

Figure 2:
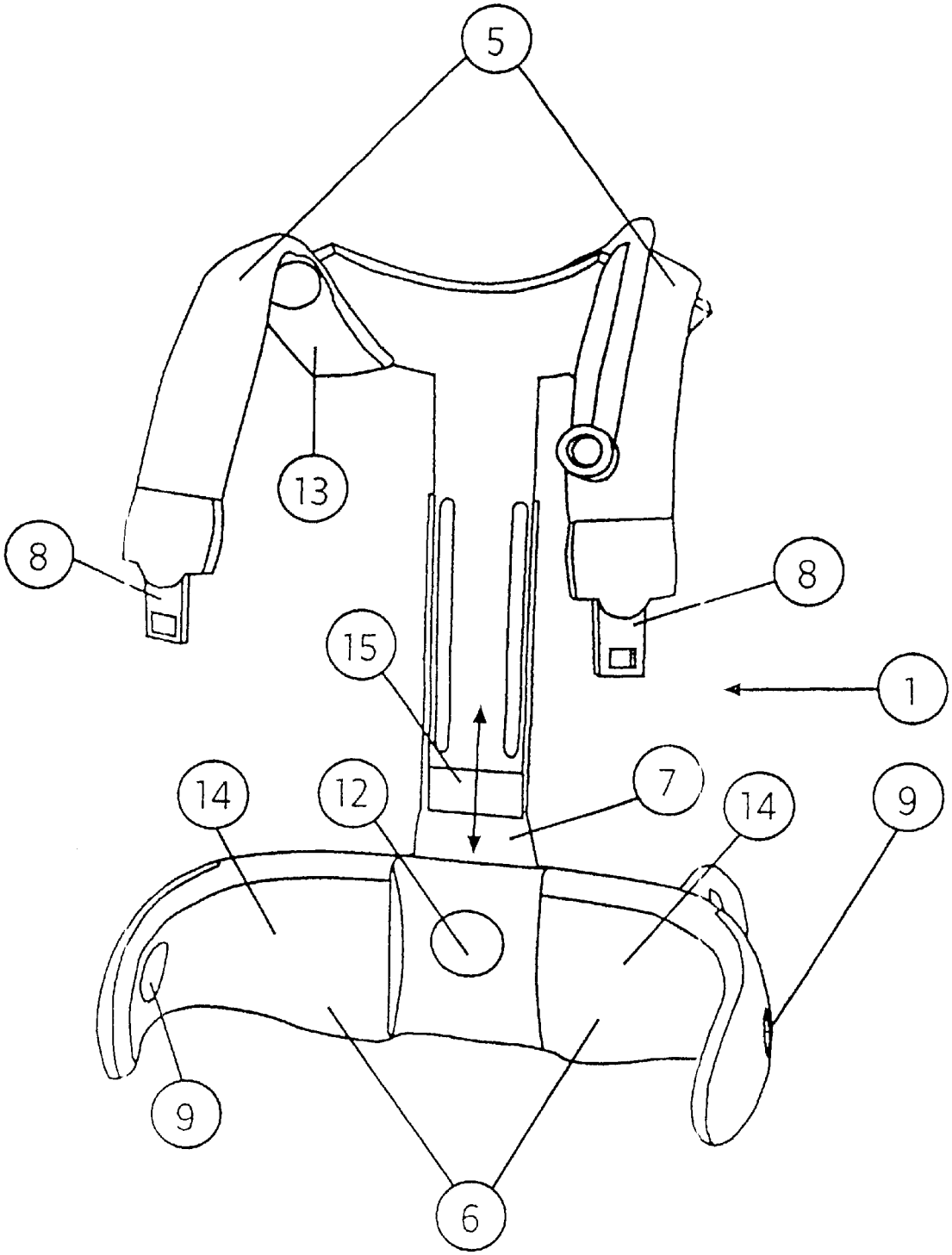
FIG. 2 is a top view of the carrying device viewed in direction A according to FIG. 1.

FIG. 2 shows a top view of the carrying device 1 with the compressed gas reservoir 2 removed and without shoulder protection shield 3 in the direction of view A according to FIG. 1. Identical components are designated with the same reference numbers as in FIG. 1. The waist belts 6 are designed as U-shaped hard shell parts and are connected to the middle part 7 by means of a hinge 12. The hinge 12 ensures better mobility for the user of the device within the carrying device 1 and the hard shell part offers protection against injury in the region of the hip. To improve the wear comfort, the inner sides of the shoulder belts 5 and of the waist belts 6 are provided with shoulder and waist padding 13, 14 respectively. For adjustment to different body heights, a longitudinal adjustment means 15, which is indicated in FIG. 2 only schematically, is arranged in the middle part 7.

Figure 3:
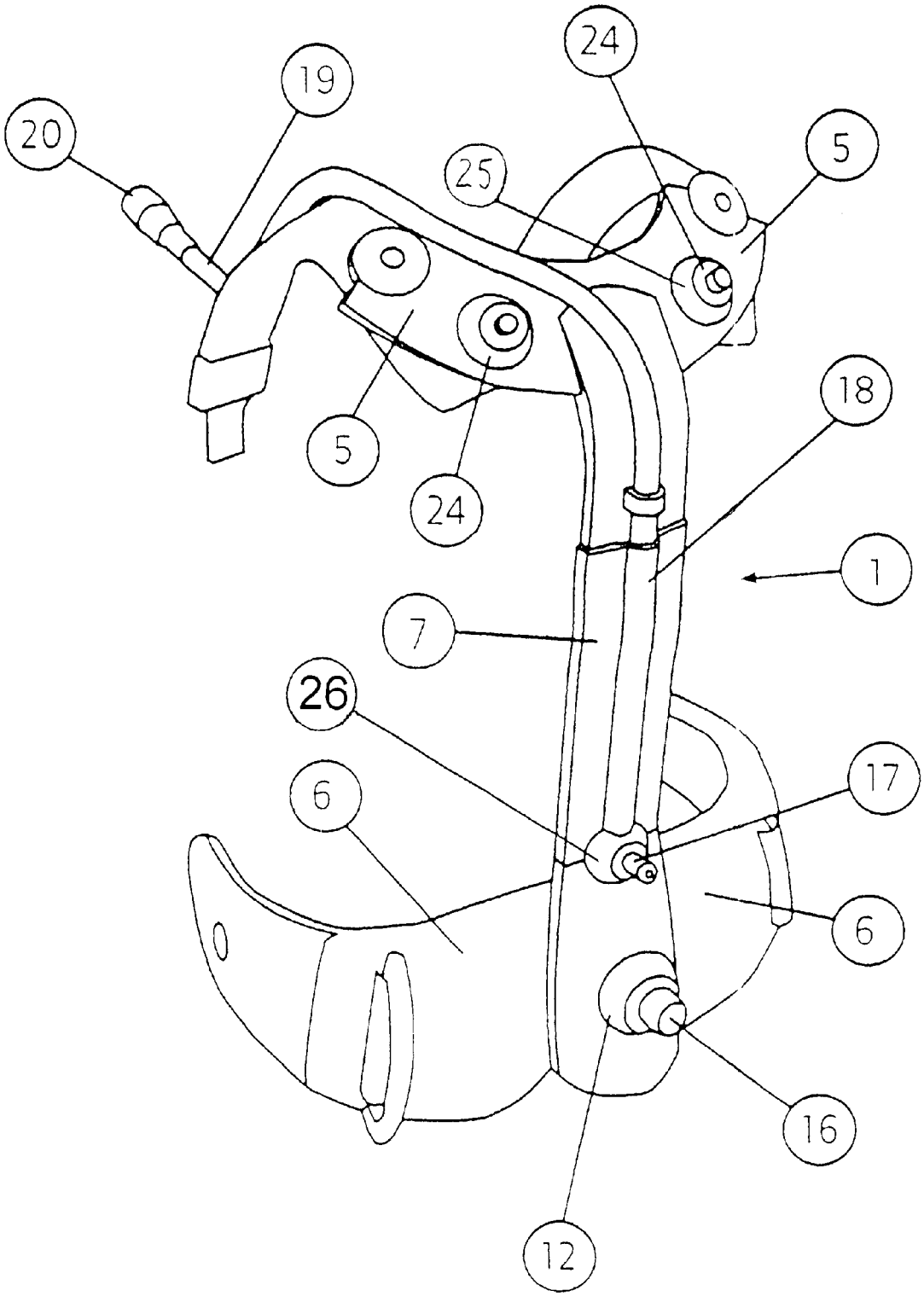
FIG. 3 is a rear view of the carrying device according to FIG. 2.

FIG. 3 shows a rear view of the carrying frame 1 according to FIG. 2. To arrange the compressed gas reservoir 2, FIG. 1, a plug type connection 16 and a plug type gas connection 17 are fastened on the rear side of the middle part 7 of the carrying frame 1. The plug type gas connection 17 is connected to a gas supply line 19 accommodated in a protective tube 18 via a pressure reducing valve 26. The gas supply line 19 is led over one of the shoulder belts 5 and is provided at its end with a quick disconnect 20, via which a gas connection can be established between a demand oxygen system, not shown in FIG. 3, and the compressed gas reservoir 2, FIG. 1. In addition, plug type connection elements 24 for the shoulder protection shield 3 are located on the shoulder belts 5 next to the middle part 7 of the carrying frame 1 with an elastic bedding 25. The shoulder protection shield 3, FIG. 1, may be used optionally if protection against heat or falling objects is needed. The shoulder protection shield 3 also covers the gas supply line 19.

Figure 4:
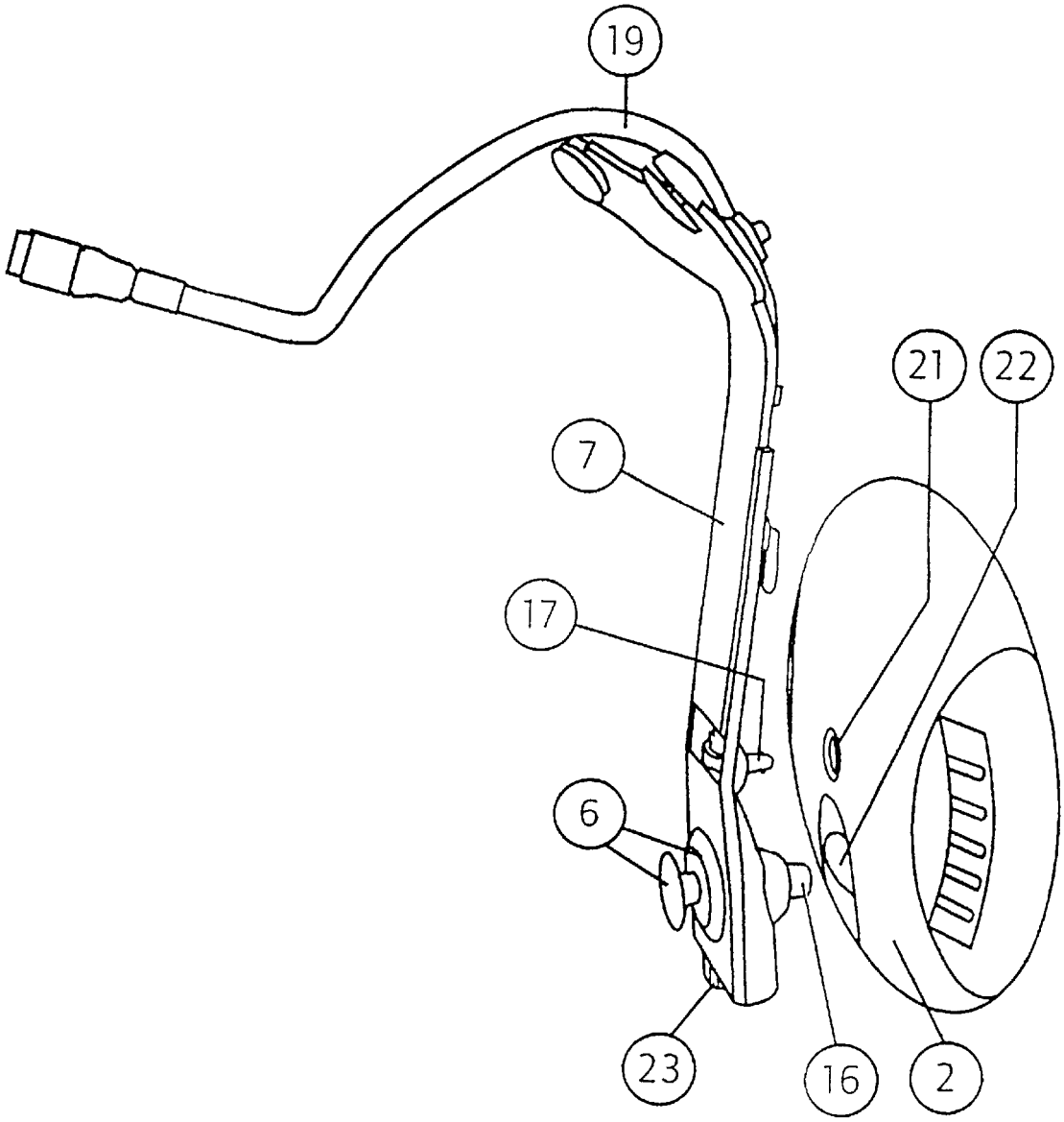
FIG. 4 is a perspective view of a compressed gas reservoir that can be connected to the carrying device.

FIG. 4 shows a side perspective view of a detail of the carrying device 1 in the connection area with the compressed gas reservoir 2. Identical components are designated with the same reference numbers as in FIG. 3. Corresponding to the plug type connections 16, 17, the compressed gas reservoir 2 has insertion openings 21, 22 for the plug type connections 16, 17. The gas connection between the compressed gas reservoir 2 and the gas supply line 19 is established via the connections 17, 21, while the connections 16, 22 are used to mechanically fix the compressed gas reservoir 2 on the carrying device 1. A knurled wheel 23 of the pressure reducing valve, not shown in FIG. 4, with which the supply pressure in the gas supply line 19 can be set, is located on a surface sloping toward the user of the device on the underside of the middle part 7. The knurled wheel 23 is mounted on a surface sloping toward the user of the device, so that it can be operated by the user of the device himself in a simple manner, but an accidental change in setting from the outside is avoided.

While a specific embodiment of the invention has been shown and described in detail to illustrate the application of the principles of the invention, it will be understood that the invention may be embodied otherwise without departing from such principles.

What is claimed is:

1. A carrying device for a respirator combined with protective clothing, the combination comprising:

protective clothing wearable on a user;

shoulder belts and said waist belts on said carrying device;

first quick-connection elements at ends of said shoulder belts and second quick-connection elements on said waist belts; and coupling elements on said protective clothing for said quick-connection elements.

2. The combination in accordance with claim 1, wherein at least some of said coupling elements are connected to one another by belts led within said protective clothing.

3. The combination in accordance with claim 1, wherein said waist belt is a one-piece, U-shaped hard shell part.

4. The combination in accordance with claim 1, wherein said carrying device has a middle part, which connects said shoulder belts to said waist belts and which is provided with a gas supply line and with a plug type connection for connection to a compressed gas reservoir.

5. The combination in accordance with claim 4, wherein said middle part is longitudinally adjustable.

6. The combination in accordance with claim 4, wherein said plug type connection is arranged in a connection area of said middle part with said waist belt.

7. The combination in accordance with claim 4, further comprising a pressure reducing valve in a line section between a plug type gas connection and said gas supply line.

8. The combination in accordance with claim 4, wherein said gas supply line is accommodated in a protective tube within said middle part.

9. The combination in accordance with claim 1, further comprising plug type connection elements for a shoulder protection shield present on said shoulder belts.

10. A device, comprising:

a respirator carrying device;

protective clothing wearable on a user;

shoulder belts and waist belts on said carrying device;

first quick-connection elements at ends of said shoulder belts and second quick-connection elements on said waist belts; and coupling elements on said protective clothing for said quick-connection elements.

11. The device in accordance with claim 10, wherein at least some of said coupling elements are connected to one another by said belts which are led within said protective clothing.

12. The device in accordance with claim 10, wherein said waist belt is a one-piece, U-shaped hard shell part.

13. The device in accordance with claim 10, wherein said carrying device has a middle part, which connects said shoulder belts to said waist belts and which is provided with a gas supply line and with a plug type connection for connection to a compressed gas reservoir.

14. The device in accordance with claim 13, wherein said middle part includes a longitudinal adjustment.

15. The device in accordance with claim 13, wherein said plug type connection is arranged in a connection area of said middle part with said waist belt.

16. The device in accordance with claim 13, further comprising a pressure reducing valve in a line section between a plug type gas connection and said gas supply line.

17. The device in accordance with claim 13, wherein said gas supply line is accommodated in a protective tube within said middle part.

18. The device in accordance with claim 10, further comprising plug type connection elements for a shoulder protection shield are present on said shoulder belts.

19. A device comprising:

a respirator carrying device;

shoulder belts and waist belts on said carrying device;

connection elements at ends of said shoulder belts and on said waist belts;

clothing surroundable of an upper torso of a user;

a plurality of coupling elements on said clothing, each of said coupling elements being directly connectable to said connection elements.

20. A device in accordance with claim 19, wherein:

said ends of said shoulder belts and said waist belts are spaced from each other on said clothing when said connection elements are connected to said coupling elements;

each of said coupling elements are individually connectable to each of said connection elements;

said clothing is surroundable of a shoulder and waist portion of the user, said clothing being protective clothing wearable on a user and protectable of a surface of the user against an external environment.

* * * * *